US008682011B2

(12) United States Patent
Kornagel et al.

(10) Patent No.: US 8,682,011 B2
(45) Date of Patent: Mar. 25, 2014

(54) METHOD FOR SWITCHING A HEARING DEVICE BETWEEN TWO OPERATING STATES AND HEARING DEVICE

(75) Inventors: Ulrich Kornagel, Erlangen (DE); Stefan Petrausch, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 535 days.

(21) Appl. No.: 12/383,981

(22) Filed: Mar. 31, 2009

(65) Prior Publication Data

US 2009/0252357 A1 Oct. 8, 2009

(30) Foreign Application Priority Data

Apr. 7, 2008 (DE) ..... 10 2008 017 552

(51) Int. Cl.
*H04R 25/00* (2006.01)

(52) U.S. Cl.
USPC ..... 381/313

(58) Field of Classification Search
USPC ..... 381/103, 123, 313
See application file for complete search history.

(56) References Cited

U.S. PATENT DOCUMENTS

| | | | | |
|---|---|---|---|---|
| 6,101,258 | A | 8/2000 | Killion et al. | |
| 7,181,033 | B2 | 2/2007 | Fischer et al. | |
| 7,340,073 | B2 | 3/2008 | Fischer | |
| 2002/0172379 | A1 * | 11/2002 | Cliff | 381/119 |
| 2003/0072465 | A1 | 4/2003 | Fischer et al. | |
| 2005/0025325 | A1 | 2/2005 | Fischer | |
| 2005/0185806 | A1 | 8/2005 | Salvador et al. | |
| 2006/0083386 | A1 | 4/2006 | Allegro-Baumann et al. | |

FOREIGN PATENT DOCUMENTS

| | | | |
|---|---|---|---|
| DE | 19822021 | A1 | 12/1999 |
| DE | 10327890 | | 1/2005 |
| DE | 10327890 | A1 | 1/2005 |
| EP | 1307072 | A2 | 5/2003 |
| EP | 1513371 | A2 | 3/2005 |
| WO | 2007057837 | A1 | 4/2011 |

* cited by examiner

*Primary Examiner* — Brian Ensey
(74) *Attorney, Agent, or Firm* — Laurence A. Greenberg; Werner H. Stemer; Ralph E. Locher

(57) ABSTRACT

Switching a hearing device from a first operating state into a second operating state is to be configured in an acoustically-friendly fashion. A first output signal power of a first audio data stream is determined for the first operating state and a second output signal power of a second audio data stream is determined for the second d operating state. Furthermore, a fading function, which represents the overall output power during a fading process, and the initial value of which corresponds to the first output signal power and the end value of which corresponds to the second output signal power, is defined. The fading process is finally implemented by mixing the audio data streams such that the overall output power corresponds to the fading function or a corresponding approximation function. Volume jumps can thus be avoided to a large degree during a switchover between operating states.

20 Claims, 3 Drawing Sheets

METHOD FOR SWITCHING A HEARING DEVICE BETWEEN TWO OPERATING STATES AND HEARING DEVICE

CROSS REFERENCE TO RELATED APPLICATIONS

This application claims priority of German application No. 10 2008 017 552.8 filed Apr. 7, 2008, which is incorporated by reference herein in its entirety.

FIELD OF INVENTION

The present invention relates to a method for switching a hearing device from a first operating state into a second operating state. Furthermore, the present invention relates to a corresponding hearing device, which can be switched between these two operating states.

BACKGROUND OF INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

A plurality of functions are frequently realized in hearing devices, which either evaluate one audio data stream on its own, or several alternative audio data streams associated therewith. Depending on the operating state and setting of the hearing device, the desired data stream is selected herefrom and forwarded to the electroacoustic converter.

SUMMARY OF INVENTION

It is often necessary during operation to have to switch between the operating states, which results in another audio data stream being selected. This switchover process is not to be implemented rigorously here, but must instead be realized as slow fading. Depending on the frequency of the fading, this process is to be as unobtrusive as possible, and may, as far as possible, thus not give rise to any noticeable volume fluctuations.

The publication DE 103 27 890 A1 discloses a realization in respect of the fading. It is based on a weighted sum of the "data streams" involved or also "signals", as is to be mentioned below. Each of the n signals $x_i$ with $i \in \{1; 2; \ldots; n\}$ is multiplied with a weighting factor $a_i$ and all n signals are then added up. In the engaged instance, an individual weighting factor, for instance $a_1$, is exactly 1 and all others zero. If a different state, for instance $a_2$, is to be switched to using fading, $a_1$ is usually gradually set to zero in accordance with a falling exponential curve (in order to realize a constant volume drop), while $a_2$ in turn gradually approaches 1. A correlation previously applied here is that all weighting factors added together should give 1. The totals formation with weighting of the individual signals $x_i$ in a total signal y is shown schematically in FIG. 2. In order to switch between operating states, all signals with the exception of one (here $x_k$) are usually faded out by the weighting factors $a_i$ with $i \neq k$ approaching zero. A trigger signal triggers the switchover process. It is also possible here to fade from any mixed state to state k, by all $a_i$ with $i \neq k$ being faded out (moving toward zero) and only the k-th weighting factor being calculated according to equation (1).

$$a_k = 1 - \sum_{\forall i \neq k} a_i \tag{1}$$

The publication EP 1 307 072 A2 also discloses a method for operating a hearing device, with interfering acoustic effects being avoided in the case of switchover processes. Here a signal which results from a first operating state and a signal, which results from a second operating state, are added with alternate weighting. In individual cases, this nevertheless results in interfering artifacts.

The object of the present invention thus consists in configuring the switchover between operating states of a hearing device in a more acoustically-friendly fashion.

This object is achieved in accordance with the invention by a method for switching a hearing device from a first operating state into a second operating state by determining a first output signal power of a first audio data stream for the first operating state, determining a second output signal power of a second audio data stream for the second operating state, defining a fading function which represents the overall output power during a fading process and the initial value of which corresponds to the first output signal power and the final value of which corresponds to the second output signal power, and performing the fading process by mixing the two audio data streams such that the overall target output power corresponds to the fading function and/or a corresponding approximation function at least in passages.

Furthermore, a hearing device is provided in accordance with the invention which can be switched from a first operating state into a second operating state, including a measuring device for determining a first output signal power of a first audio data stream for the first operating state and for determining a second output signal power of a second audio data stream for the second operating state as well as a control device for performing a fading process by mixing the two audio data streams such that the overall output power corresponds to a predetermined fading function and/or a corresponding approximation function at least in passages during a fading process, the initial value of which is identical to the first output signal power and the final value of which is identical to the second output signal power.

It is thus advantageously possible to effect a fading both in the case of correlated and also uncorrelated signals, said fading being characterized by barely noticeable volume fluctuations.

In a special instance, the two output signal powers of the operating states, between which switching is to take place, can be equally high. In this case, the fading function is selected to be constant so that the hearing device wearer is not able to perceive volume fluctuations between the two operating states.

If the two output signal powers of the two operating states are different, a simple volume fading function can be realized as a result such that a linear transition is used between both output signal powers. Volume jumps can be avoided in this way.

The data stream determining the overall output power during the fading process can be regarded as a linear combination of at least the first and the second audio data stream, with each audio data stream being weighted with a weighting factor. This renders it easily possible to calculate the output power from the weighting factors with the aid of the expectation value.

The weighting factors may effect an exponential fading out (approximation function) of the first audio data stream using a predetermined time constant and a fading in of the second audio data stream in accordance with the previously defined (volume) fading function. Here the predetermined time constant of the approximation function for the fading out can be independent of a time constant of the fading function (P(y)) for the fading in. Using an approximation function during part of the fading process already saves on computing time.

A minimal effort approach is particularly advantageous, according to which the weighting factors are iteratively calculated exclusively with one or several additions and/or multiplications. In this instance, multiplications may often also be approached by bit-shifting operations and possibly other additions. Exponential functions, which indicate significant computing time, can be avoided in this way.

A further reduction in effort can be achieved in that the weighting factor for fading in the second audio data stream is approached by a difference between a target weighting factor determined by the fading function and a further exponential fading out function with a second time constant. In particular, as a result, a very slight volume fluctuation can be achieved with very little effort in the case of fading from one operating state to another.

BRIEF DESCRIPTION OF THE DRAWINGS

The present invention is described in more detail with the aid of the appended drawings, in which.

DETAILED DESCRIPTION OF INVENTION

The exemplary embodiments illustrated in more detail below represent preferred embodiments of the present invention.

The solution according to the invention is aimed at minimizing the volume fluctuations of the total signal y during the switchover process. The volume is to be strictly monotone, in the ideal case is even to increase and/or drop from the actual value to the target value with a constant speed. For consonant signal $x_1$ to $x_n$, this means that no fluctuations in the volume are to occur. In principle, any volume trend, i.e. any desired fading function of the power, is however possible.

The main idea behind achieving the afore-posed object is to combine all signals as random processes and to set the weighting coefficients such that the power of the output signal P(y) follows a desired, for instance as smooth as possible a course, at least in the stochastic means.

Example 1

Figure 3:
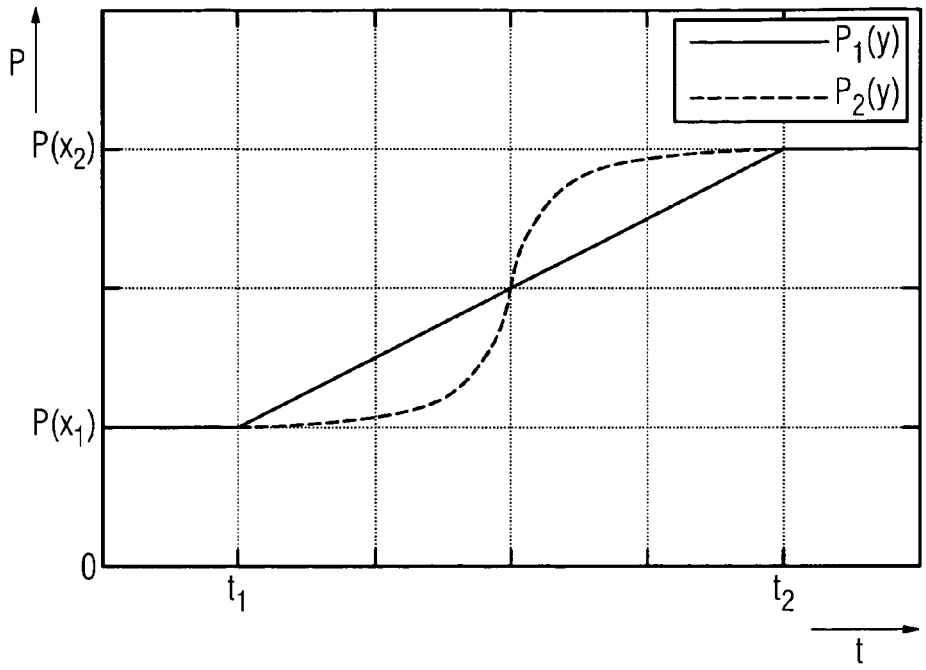
FIG. 3 shows the course of the output power in the case of two different fading functions.

A switchover between two signals (n=2) $x_1$ and $x_2$ is to take place. The associated switchover using fading is to start at point in time $t_1$ and to terminate at point in time $t_2$. This fading process is shown in FIG. 3. As both signals have different volumes, a change in the volume cannot be avoided. As unnoticeable as possible a transition between both states is thus to take place $$P(x_1) \rightarrow P(x_2).$$

FIG. 3 represents by way of example two possibilities for the transition from $P(x_1)$ to $P(x_2)$. Each of the two has specific advantages, which are beneficial in the individual case. The actual course of the output power, i.e. the power of the mixed signal, thus remains variable below and is identified with P(y).

The power of the output signal can be calculated with the aid of the expectation value. In principle, the power of a random process is the expectation value of the square $$P(y)=\epsilon\{YY\}=\epsilon\{Y^2\}. \tag{2}$$

Figure 1:
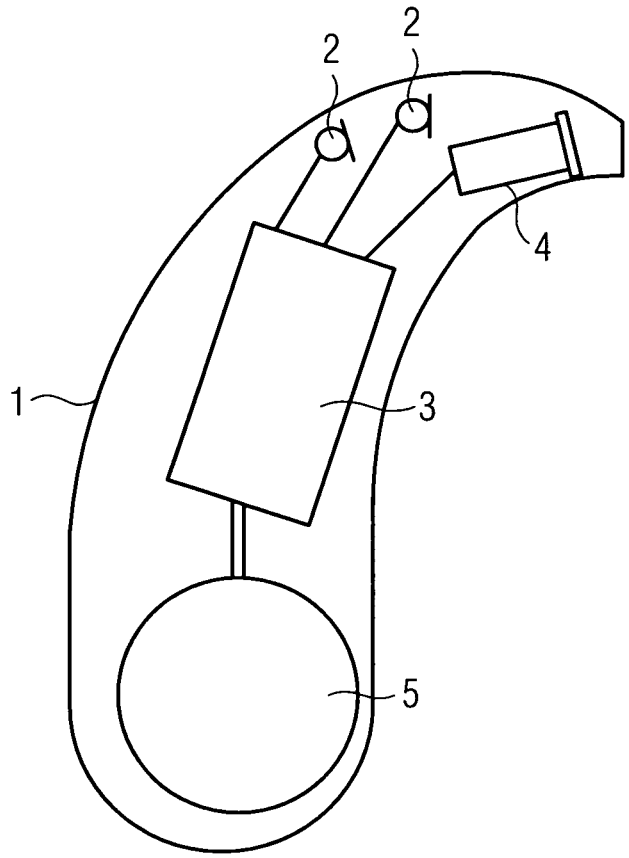
FIG 1 (Prior art)
FIG. 1 shows the main design of a hearing device in accordance with the prior art.
Figure 2:
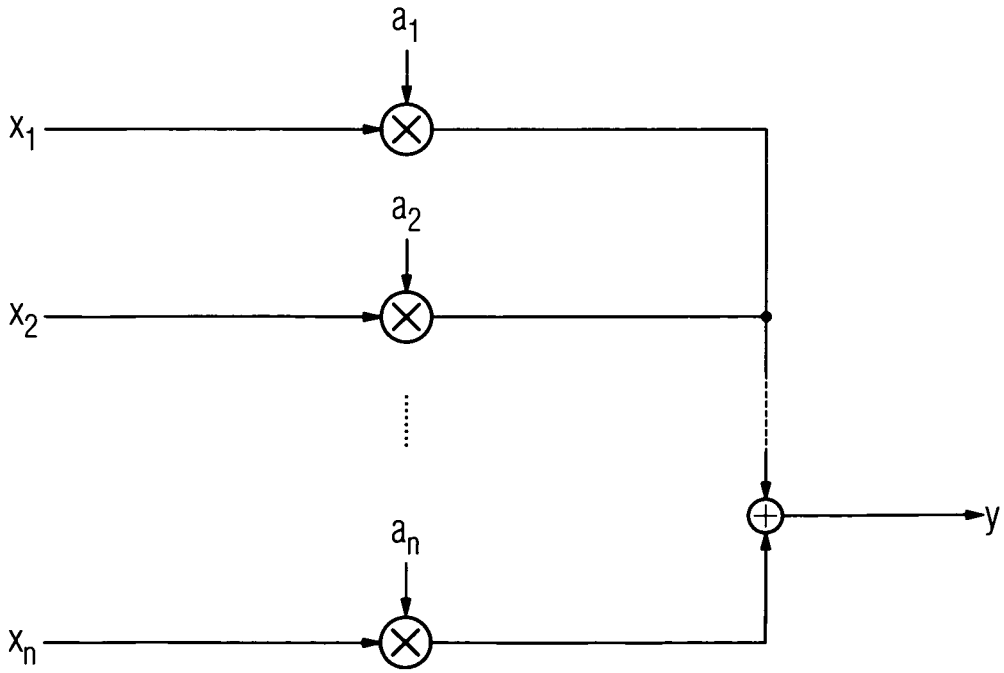
FIG. 2 shows a circuit diagram for the weighted totals formation of individual signals.

According to FIG. 2, the random process Y is a linear combination of the input processes $X_i$, $i \epsilon \{1; 2; \ldots; n\}$, $$Y=a_1X_1+a_2X_2+\ldots+a_nX_n. \tag{3}$$

It is assumed below, without loss of generality, that fading to the first operating state is to take place, in other words that $y(t)|_{t>t_2}=x_1(t)$. Equation (3) can be simplified with the aid of a scalar product to form $$Y = a_1X_1 + (a_2 \ \ldots \ a_n)\begin{pmatrix} X_2 \\ \vdots \\ X_n \end{pmatrix} = a_1X_1 + a^TX. \tag{4}$$

According to Eberhard Hänsler, "Statistische Signale" [Statistical signals], volume 2, Springer-Verlag, 1997 and Herbert Schlitt, "Systemtheorie für stochastische Prozesse", [Systems theory for stochastic processes], Springer Verlag, 1992, it is possible to calculate the expectation value of the square as follows.

$$\varepsilon\{Y^2\} = a_1^2\varepsilon\{\dot{X}_1^2\} + 2a_1\sum_{i=2}^{n} a_i\varepsilon\{X_1X_2\} + a^T\varepsilon\{XX^T\}a. \tag{5}$$

Here both the auto-correlates (in other words the powers) of the signals as well as the cross-correlates are needed between the signals. These stochastic parameters can either be estimated/measured by observing the signals or result inevitably from the generation of the input signals $x_1$ to $x_n$.

According to equation (2), the expectation value of the square is to follow a predetermined function P(y). If all weighting factors $a_i=a_i(t)$, $i\in\{2; 3; \ldots; n\}$ are considered as given (the signals $x_2$ to $x_n$ are to be "faded out", the weighting factors associated therewith are then to aspire to zero in accordance with a given function), then the weighting factor $a_1=a_1(t)$ is calculated by $$a_1(t) = -\frac{\sum_{i=2}^{n} a_i\varepsilon\{X_1X_i\}}{\varepsilon\{X_1^2\}} + \pm\frac{\sqrt{\left(\sum_{i=2}^{n} a_i\varepsilon\{X_1X_i\}\right)^2 - \varepsilon\{X_1^2\}(a^T\varepsilon\{XX^T\}a - P(y))}}{\varepsilon\{X_1^2\}} \tag{6}$$

with purely positive weighting factors usually being preferred, the sum of the two terms and not the difference thereof is thus mostly assumed.

Example 2

$x_1$, $x_2$ and $x_3$ are three consonant, mean value-free signals which are uncorrelated with one another and have the power $P(x_i)=1$, $i\in\{1; 2; 3\}$. The required stochastic parameters are thus $$\varepsilon\{X_1^2\} = 1,\ \varepsilon\{X_1X_2\} = \varepsilon\{X_1X_3\} = 0 \text{ und } \varepsilon\{XX^T\} = \begin{pmatrix} 1 & 0 \\ 0 & 1 \end{pmatrix}.$$

Since all input signals have the same power and are preferably stationary, the output signal is to have absolutely no fluctuations. $P(y)\equiv 1$ applies. Equation (6) is thus simplified to $$a_1(t)=\sqrt{1-a^Ta}. \tag{7}$$

The perceived volume of the non-selected signals is to drop with a constant speed. $a_2(t)$ and $a_3(t)$ thus have an exponential curve. Here $$a_2(t) = a_2(t_1)\cdot e^{-\frac{t-t_1}{\tau}},\ a_3(t) = a_3(t_1)\cdot e^{-\frac{t-t_1}{\tau}}, \tag{8}$$

applies, with $t_1$ being the start time of the fading process and r the time constant of the fading out process. Equation (7) is also simplified to $$a_1(t) = \sqrt{1 - e^{-\frac{2(t-t_1)}{\tau}} a^T(t_1)a(t_1)}\,. \tag{9}$$

Figure 4:
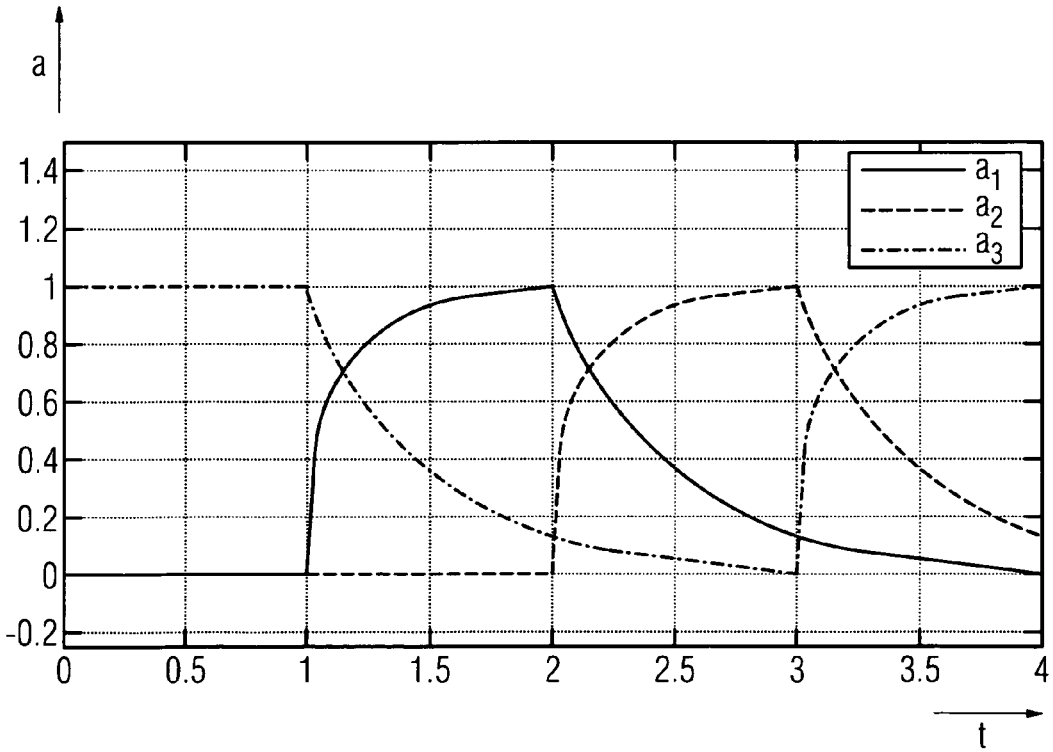
FIG. 4 shows the temporal course of weighting factors in the case of several fadings.

FIG. 4 shows the resulting weighting factors $a_1$ to $a_3$. The system is in operating state 3 at the start time, i.e. the weighting factor $a_3=1$ and $a_1=a_2=0$. The operating state is changed at point in time t=1 from operating state 3 to operating state 1, i.e. $a_3$ is faded out to 0, $a_1$ is faded in and $a_2$ remains 0. At point in time $t_2$ there is a change into the operating state 2 and at point in time $t_3$ there is another change into the operating state 3. The individual weighting factors follow the trends of equations (8) and (9).

An exemplary embodiment is subsequently described, which represents a minimal effort approach. The starting point is that complicated mathematical functions such as exponential functions and root functions have to be avoided in the case of hearing devices, since they would consume too much chip area and too much electricity. This also applies to avoiding real multiplications. It is for this reason that the oscillating exponential functions, which are required for the fading out, are restricted by a series of multiplications with very simple coefficients. The weighting factors for the fading out are calculated as follows (here by way of example for $a_2$)

$$a_2(t+T)=(1-2^{-v})a_2(t)=a_2(t)-2^{-v}a_2(t), \tag{10}$$

and/or in a time-discrete notation $$a_2[k+1]=(1-2^{-v})a_2[k]=a_2[k]-2^{-v}a_2[k]. \tag{11}$$

The variable $v \in \square_0$ is in this case a natural number, as a result of which only certain time constants $$\tau_v = -\frac{T}{\ln(1-2^{-v})}$$

can still be realized, which is not usually interfering for instance. For implementation according to the unexamined German application (with a simple subtraction according to equation (1)), two additions and a bit shifting are thus needed in order to form n=2 weighting factors.

The disadvantage in terms of equation (6) consists in the complex root calculation. Compared to simple variants according to the unexamined German application DE 103 27 890 A1, the additional effort involved for hearing devices is for the most part unjustifiable. A clear more computationally efficient approach is thus shown here, which however corresponds to equation (6).

If $\tau_a$ is the time constant for fading out, which can be realized in accordance with equation (11) (corresponding to the natural number $v_a$). Then all fading out weighting factors are to be formed (discrete starting point in time is k=0) as follows $$\begin{aligned} a_i[k] &= e^{-\frac{kT}{\tau_a}}\cdot a_i[0] \\ &= (1-2^{-v_a})^k\cdot a_i[0],\quad i\in\{2; 3; \ldots; n\}. \end{aligned} \tag{12}$$

An exponential fading out of the signal parts thus takes place, as a result of which the volume drops constantly. The fading-in weighting factor is now to be formed such that $$a_1[k] = 1 - e^{-\frac{kT}{\tau_e}}(1 - a_1[0])\cdot \tag{13}$$

Here 1 is effectively the target value for the weighting factor $a_1$ and the difference between the target value and the current value is faded out with an exponential function. The time constant $\tau_e$ of this exponential fading out function is however different to the time constant $\tau_a$ and must be optimized in accordance with equation (6). It does not necessarily fit into the implementation schema according to equation (11). The following approximation is however perfectly adequate $$e^{-\frac{T}{\tau_e}} \approx (1 - 2^{-v_{e1}} \pm 2^{-v_{e2}}). \tag{14}$$

The effort involved in this implementation would thus amount to four additions and two bit shifting operations for n=2 weighting factors, which is completely justifiable in terms of the expected advantage (few volume fluctuations during fading). The fading in time constant $\tau_e$ is optimized such that equation (11) is approximated as effectively as possible, with the optimization criterion nevertheless possibly being subjected to various boundary conditions. For instance, a request may be made for the volume not to be increased in any case during the fading process.

Example 3

A switch between two consonant uncorrelated signals $x_1$ and $x_2$ is to take place using fading. The power of the two signals is 1. Three fading variants are tested:

1. the variant according to DE 103 27 890 A1 with $a_1=1-a_2$ as known from the prior art,
2. a significantly computationally reduced variant according to equation (13) with $$e^{-\frac{T}{\tau_e}} = (1 - 2^{-v_e}),$$

in which the difference in respect of the target value with another time constant is faded out as the other signals, 3. and the additional computationally reduced version according to equation (14) with $$e^{-\frac{T}{\tau_e}} \approx (1 - 2^{-v_{e1}} \pm 2^{-v_{e2}}).$$

Figure 5:
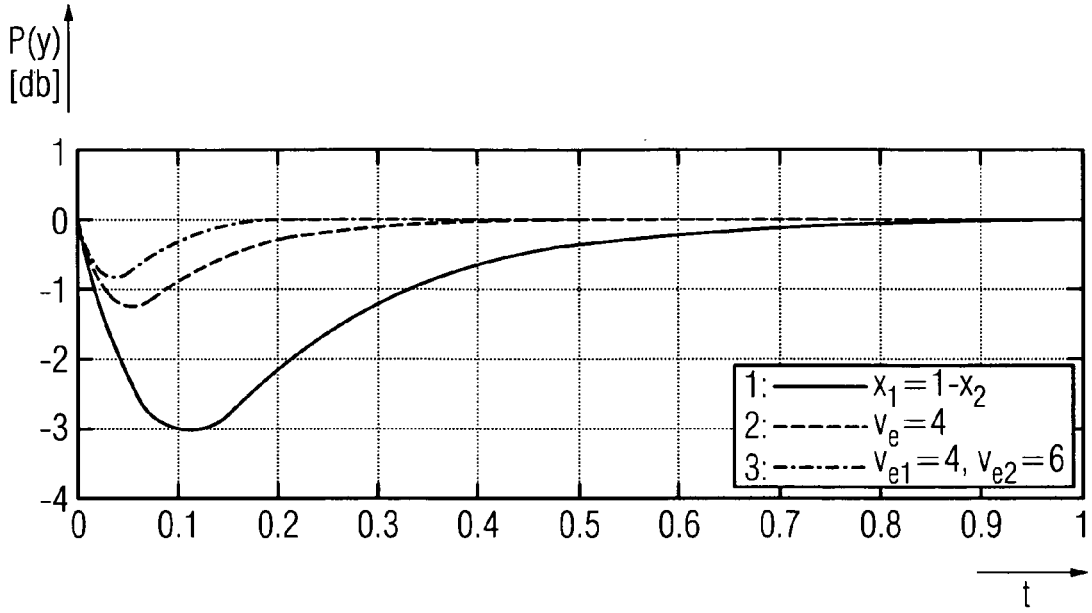
FIG. 5 shows the temporal course of output powers in the case of different fading strategies and FIG. 6 shows a block diagram for switching between unsteady signals using fading.

The fading-out time constant is $v_a=5$. FIG. 5 shows the behavior of the output power P(y) over time for all three variants. In the case of the first method according to the prior art, there is a drop in volume of 3 dB. The volume and/or the output power only fluctuates by 0.8 dB with the third solution. The two variants 2 and 3 thus represent practical solutions when realizing an ideal constant fading function. The approximation functions in FIG. 5 barely lead to a loss of comfort, but instead to a clear saving in terms of computation effort compared with the ideal, straight curve.

The main ideas behind the inventive solution can be summarized as follows:

It was firstly identified that volume fluctuations generally appear when switching from one operating state to another using fading. Stochastic means (for instance cross-correlation and auto-correlation) are used in order to quantify these volume fluctuations. The stochastic parameters can either be estimated from the signals, measured or derived from the system characteristics. In order to reduce effort, it is sufficient not to take the actual stochastic parameters (for instance the correlation) but instead similar or modified parameters depending on the problem. In any case, it is possible to achieve a desired trend in the volume for the fading process.

It is similarly possible to fade from any mixed ratio to another arbitrary mixed ratio (for instance $$\left(\text{for instance } \frac{1}{4}x_1 + \frac{3}{4}x_2 \text{ to } \frac{1}{2}x_1 + \frac{1}{2}x_2\right)$$

using these methods.

The above general and/or ideal approach can, as was explained in detail in the second exemplary embodiment, be approached by an effort-reduced approach. Here the fading-in can be realized by fading out the difference in respect of the final value (which may be arbitrary). Furthermore, different time constants and/or time constants which are dependent on one another may be selected for the fading in and out, since the deduction and optimization of the time constants from the ideal approach is relatively complicated.

Two realization examples are shown here below:

Realization Example 1

Switchover Using Fading in the Case of Directional Microphony

Different directional characteristics (front, rear, omni, etc.) can be formed from the microphones of a hearing device. Due to changes in the acoustic conditions, it is often necessary to switch between these states. To avoid the "clicking noises" which usually occur as a result, a switchover using fading must take place, which is, as far as possible, not to determine any volume fluctuations.

A switchover process using fading, in which the volume of the background noise is constant, must be realized according to equation (6). In simple terms, it is possible to assume for instance that the cross-correlation of the signals is zero. All necessary variables can thus be determined in advance. If the implementation outlay for equation (6) is too high, it is possible to follow the approach according to equation (13). The time constant $\tau_e$, which was optimized according to the desired criteria, can be significantly quantized here.

Realization Example 2

Switchover Between Unsteady Signals Using Fading

Figure 6:
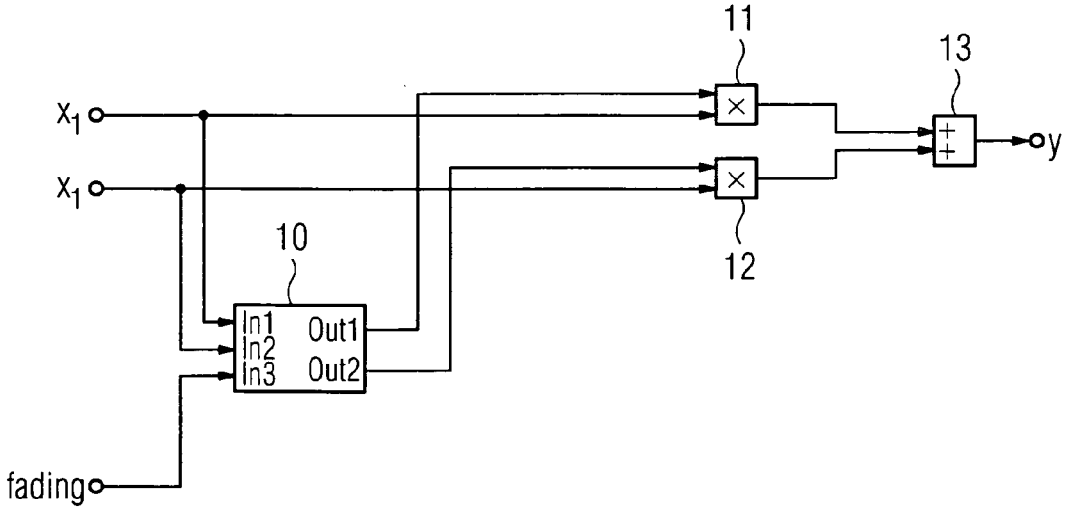

If a switchover between unsteady signals using fading takes place unnoticed, in which it is not possible to determine the stochastic parameters in advance, a circuit arrangement according to FIG. 6 is recommended. A weighting block 10 estimates the current stochastic characteristics of the signals $x_1$ and $x_2$ and forms therefrom two corresponding weighting factors. If necessary, the weighting block 10 has a further input in order to control the fading function. Two multipliers 11 and 12 multiply the signals $x_1$ and $x_2$ with the corresponding weighting factors. The weighted signals are added in an adder 13 to produce the total signal. The necessary current stochastic parameters are thus calculated online and used for the weighting factors.

The invention claimed is:

1. A method for switching a hearing device from a first operating state to a second operating state, comprising:

determining a first output signal power $P(x_1)$ of a first audio data stream $x_1$ for the first operating state;

determining a second output signal power $P(x_2)$ of a second audio data stream $x_2$ for the second operating state;

defining a fading function P(y) that represents an overall target output power for an output signal y during a fading process when switching operating states the fading function P(y) having an initial value which corresponds to the first output signal power $P(x_1)$ and an end value which corresponds to the second output signal power $P(x_2)$; and performing the fading process by mixing the first and second audio data streams such that an overall output power of the output signal y corresponds to the overall target output power in accordance with the fading function P(y), and wherein the mixing includes calculating fading in and fading out weighting factors to effect fading in of the second audio data stream and exponentially decreasing fading out of the first audio data stream, respectively, wherein the fading out weighting factor is calculated in accordance with a corresponding approximation function that effects an exponential fading out using calculations that approximate exponential fading in lieu of using actual exponential calculations at least during part of the fading process, and wherein the fading in weighting factor is calculated in accordance with the fading function P(y).

2. The method as claimed in claim 1, wherein when the first output signal power is equal to the second output signal power the fading function P(y) is constant so that during the fading process the output signal y remains constant when transitioning from the initial value to the end value.

3. The method as claimed in claim 1, wherein when the first output signal power is different than the second output signal power the fading function P(y) is linear so that during the fading process a change of the output signal y from the initial value to the end value occurs at a constant speed.

4. The method as claimed in claim 3, wherein the first audio data stream is multiplied with the fading out weighting factor to form a first weighted audio data stream and the second audio data stream is multiplied with the fading in weighting factor to form a second weighted audio data stream, and wherein the determining the overall target output power during the fading process is a linear combination of at least the first and second weighted audio data streams.

5. The method as claimed in claim 4, wherein the fading out weighting factors effects the exponential fading out of the first audio data stream with a predetermined time constant according to the approximation function and the fading in weighing factors effect a fading in of the second audio data stream in accordance with the fading function P(y).

6. The method as claimed in claim 5, wherein the predetermined time constant of the approximation function for the fading out is independent of a time constant of the fading function P(y).

7. The method as claimed in claim 4, wherein the approximation function approximates exponential functions for the fading process by iteratively calculating the weighting factors with one or several operations comprising additions, multiplications, and bit shifting in lieu of actual exponential calculations.

8. The method as claimed in claim 4, wherein the weight factor for fading in the second audio data stream is approached by a difference between a target weighting factor determined by the fading function and a further exponential fading out function with a second time constant.

9. A method for switching a hearing device from a first operating state to a second operating state, comprising:

determining a first output signal power $P(x_1)$ of a first audio data stream $x_1$ for the first operating state;

determining a second output signal power $P(x_2)$ of a second audio data stream $x_2$ for the second operating state;

defining a volume fading function P(y) that represents an overall target output power for an output signal y during a fading process when switching operating states the fading function P(y) having an initial value which corresponds to the first output signal power $P(x_1)$ and an end value which corresponds to the second output signal power $P(x_2)$; and performing the fading process by mixing the first and second audio data streams such that the overall output power of the output signal y corresponds to the overall target output power in accordance with the volume fading function P(y), and wherein the mixing includes calculating fading in and fading out weighting factors to effect fading in of the second audio data stream in accordance with the volume fading function P(y) and exponentially decreasing fading out of the first audio data stream in accordance with a corresponding approximation function that effects an exponential fading out using calculations that approximate exponential fading in lieu of using actual exponential or root calculations at least during part of the fading process, whereby using the approximation function saves computing time over a computationally complicated exponential and or root function.

10. The method as claimed in claim 9, wherein when the first output signal power is equal to the second output signal power the volume fading function P(y) is constant so that during the fading process the output signal y remains constant when transitioning from the initial value to the end value.

11. The method as claimed in claim 9, wherein when the first output signal power is different than the second output signal power the volume fading function P(y) is linear so that during the fading process a change of the output signal y from the initial value to the end value occurs at a constant speed.

12. The method as claimed in claim 9, wherein the first audio data stream is multiplied with a fading out weighting factor to form a first weighted audio data stream and the second audio data stream is multiplied with a fading in weighting factor to form a second weighted audio data stream, and wherein the determining the overall target output power during the fading process is a linear combination of at least the first and second weighted audio data streams.

13. The method as claimed in claim 12, wherein the fading out weighting factors effect the exponential fading out of the first audio data stream with a predetermined time constant according to the approximation function and the fading in weighing factors effect a fading in of the second audio data stream in accordance with the volume fading function P(y).

14. The method as claimed in claim 13, wherein the predetermined time constant of the approximation function for the fading out is independent of a time constant of the volume fading function P(y).

15. The method as claimed in claim 12, wherein the approximation function approximates exponential functions for the fading process by iteratively calculating the weighting factors with one or several operating comprising additions, multiplications, and bit shifting in lieu of actual exponential or root calculations.

16. The method as claimed in claim 12, wherein the weighting factor for fading in the second audio data stream is approached by a difference between a target weighting factor determined by the fading function P(y) and a further exponential fading out function with a second time constant.

17. A hearing device switchable from a first operating state into a second operating state, comprising:

a measuring device for determining a first output signal power $P(x_1)$ of a first audio data stream $x_1$ for the first operating state and for determining a second output signal power $P(x_2)$ of a second audio data stream $x_2$ for the second operating state; and a control device for implementing a fading process when switching operating states by mixing the first and second audio data streams such that an overall output power for an output signal y corresponds to a predetermined fading function P(y) by fading in of the second audio data stream in accordance with the fading function P(y) and exponentially decreasing fading out of the first audio data stream in accordance with a corresponding approximation function that effects an exponential fading out using calculations that approximate exponential fading in lieu of using actual exponential or root calculations at least during part of the fading process, wherein the fading function P(y) has an initial value which is identical to the first output signal power $P(x_1)$ and a final value which is identical to the second output signal power $P(x_2)$.

18. The hearing device as claimed in claim 17, wherein when the first output signal power is equal to the second output signal power the fading function is constant so that during the fading process the output signal y remains constant when transitioning from the initial value to the end value, and wherein when the first output signal power is different than the second output signal power the fading function P(y) is linear so that during the fading process a change of the output signal y from the initial value to the end value occurs at a constant speed.

19. The hearing device as claimed in claim 18, wherein the first audio data stream is multiplied with a fading out weighting factor to form a first weighted audio data stream and the second audio data stream is multiplied with a fading in weighting factor to form a second weighted audio data stream, and wherein the determining the overall target output power during the fading process is a linear combination of at least the first and second weighted audio data streams.

20. The hearing device as claimed in claim 19, wherein the fading out weighting factors effect the exponential fading out of the first audio data stream with a predetermined time constant according to the approximation function and the fading in weighing factors effect a fading in of the second audio data stream in accordance with the fading function P(y), wherein the predetermined time constant of the approximation function for the fading out is independent of a time constant of the fading function P(y).

* * * * *